US006113757A

United States Patent [19]

Shimamune et al.

[11] Patent Number: 6,113,757

[45] Date of Patent: Sep. 5, 2000

[54] ELECTROLYTIC CELL FOR ALKALI HYDROXIDE PRODUCTION

[75] Inventors: Takayuki Shimamune, Tokyo; Masashi Tanaka, Kanagawa; Shuhei Wakita, Kanagawa; Takahiro Ashida, Kanagawa; Yoshinori Nishiki, Kanagawa, all of Japan

[73] Assignee: Permelec Electrode Ltd., Kanagawa, Japan

[21] Appl. No.: 09/012,001

[22] Filed: Jan. 22, 1998

[30] Foreign Application Priority Data

Jan. 22, 1997 [JP] Japan ..... 9-021922
Feb. 10, 1997 [JP] Japan ..... 9-041632

[51] Int. Cl.[7] ..... C25B 9/00; C25C 7/00; C25D 17/00

[52] U.S. Cl. ..... 204/265; 204/263; 204/266

[58] Field of Search ..... 204/263, 265, 204/266, 282, 283, 258; 205/510, 516

[56] References Cited

U.S. PATENT DOCUMENTS 4,107,022 8/1978 Strempel et al. ..... 205/265
4,313,813 2/1982 Johnson et al. ..... 204/263

*Primary Examiner*—Kathryn Gorgos
*Assistant Examiner*—Wesley A. Nicolas
*Attorney, Agent, or Firm*—Sughrue, Mion, Zinn, Macpeak & Seas, PLLC

[57] ABSTRACT

An electrolytic cell for producing an alkali hydroxide using a gas diffusion cathode. A moistened oxygen-containing gas is uniformly supplied to the surface of the gas diffusion cathode by means of a gas distributing mechanism, such as at least one gas diffuser pipe having a plurality of openings facing the cathode surface.

15 Claims, 2 Drawing Sheets

ELECTROLYTIC CELL FOR ALKALI HYDROXIDE PRODUCTION

FIELD OF THE INVENTION

This invention relates to an electrolytic cell having a gas diffusion cathode which is used for producing an alkali hydroxide by alkali chloride electrolysis. More particularly, this invention relates to an electrolytic cell for producing an alkali hydroxide in which an oxygen-containing gas is uniformly distributed over the whole surface of the gas diffusion cathode.

BACKGROUND OF THE INVENTION

The electrolysis industry represented by alkali chloride electrolysis has an important role in the material industries. Alkali chloride electrolysis, while significant, consumes much energy, and energy savings therefor has become a world-wide concern. Taking alkali chloride electrolysis as an example, for the purpose of achieving energy savings as well as solving environmental problems, transitions have been made from a mercury process to a diaphragm process and then to an ion exchange membrane process, thus affording an energy savings of about 40% over a period of about 25 years. Notwithstanding the foregoing, the power cost is 50% of the total manufacturing cost such that there is a great need for further energy savings. However, as far as present processes are concerned, manipulations for achieving additional energy savings have almost reached the highest possible level. A fundamental change, such as a change in the electrode reaction, must be made before further energy savings can be realized. Under these circumstances, application of a gas diffusion electrode used in fuel cells is the most promising of conceivable means for producing power savings.

The cathodic reaction using a conventional metal electrode, represented by reaction formula (1), is changed to reaction formula (2) when a gas diffusion electrode is used as a cathode.

$$2NaCl+2H_2O \rightarrow Cl_2+2NaOH+H_2; E_O=2.21\ V \quad (1)$$

$$2NaCl+\tfrac{1}{2}O_2+H_2O \rightarrow Cl_2+2NaOH; E_0=0.96\ V \quad (2)$$

That is, replacement of a metal electrode with a gas diffusion electrode reduces the potential from 2.21 V to 0.96 V, theoretically affording energy savings of about 65%. Hence, various studies have been directed toward practical implementation of alkali chloride electrolysis using a gas diffusion electrode.

A gas diffusion electrode generally has a semi-hydrophobic or water-repellent structure, which is composed of a hydrophilic reactive layer having supported thereon a catalyst (e.g., a platinum catalyst) and a water-repellent gas diffusion layer joined together. Both the reactive layer and the gas diffusion layer are formed using polytetrafluoro-ethylene (hereinafter abbreviated as PTFE) as a binder resin. The properties of PTFE are advantageously used by incorporating the PTFE in a high proportion in the gas diffusion layer and in a low proportion in the reactive layer.

Application of the gas diffusion electrode to alkali chloride electrolysis gives rise to several problems. In order for a gas diffusion electrode to work properly as a cathode in alkali chloride electrolysis, ample oxygen-containing gas should be supplied to its surface. If the gas supply is insufficient, the reaction at the cathode is accompanied by the evolution of hydrogen. It follows that a large quantity of energy is consumed and, in some cases, there is a danger of explosion with the oxygen-containing gas thus supplied. If an adequate amount of an oxygen-containing gas is supplied to the cathode, a water producing reaction between hydrogen ion and oxygen takes place on the cathode to achieve satisfactory energy savings. Thus, the high performance of a gas diffusion electrode is only revealed under limited conditions. However, few investigations have been carried out to identify the electrolysis conditions that promote the high performance of a gas diffusion electrode, especially the manner of supplying gas to the cathode surface. For example, an oxygen-containing gas must be supplied to the cathode surface not only in sufficient amount but also uniformly. If not, the gas diffusion electrode would have a portion that functions properly and a portion that does not, thus failing to achieve its full function as a whole. Non-uniformity in the gas supply tends to occur when the temperature of a member of the electrolytic cell varies or when there is a difference in temperature between a humidifier and the electrolytic cell.

In an electrolytic cell using a gas diffusion electrode for producing an alkali hydroxide, moisture is typically mixed with an oxygen-containing gas to thereby supply a moistened oxygen-containing gas for the purpose of adjusting the concentration of the alkali hydroxide thus produced.

While the optimum concentration of catholyte in the general electrolysis of sodium chloride (brine) by an ion-exchange membrane process varies depending on the kind of ion-exchange membrane, it is considered to be 30 to 35% for, e.g., sodium hydroxide production. The sodium ion migrating through an ion-exchange membrane from an anode chamber to a cathode chamber is accompanied by about 3.5 to 4.0 molecules of water. With the accompanying water, the sodium hydroxide produced in the cathode chamber will have a concentration of about 42%. If the sodium hydroxide concentration exceeds 35%, the ion-exchange membrane will have an increased electric resistance, resulting in an increase in voltage and a decrease in the life of the ion-exchange membrane. The water deficiency is 1 to 1.5 molecules, in terms of water accompanying sodium, per sodium molecule. The number of deficient molecules is 2 to 3 times that of the oxygen gas that is supplied.

The concentration of the sodium hydroxide produced in the cathode chamber can be optimized by mixing the oxygen-containing gas supplied to the cathode chamber with high-temperature saturated steam, and supplying the thus moistened gas to the cathode chamber while maintaining that temperature. This method tends to cause condensation with a slight change in temperature. Water may be supplemented in the form of mist. In this case, too, a water supply gradient tends to be generated, and it is difficult to uniformly supply water over the whole surface of the gas diffusion cathode.

These disadvantages are liable to occur particularly in a large-sized electrolytic cell, causing a bottleneck in applying an electrolytic cell using a gas diffusion electrode to the industrial production of an alkali hydroxide.

SUMMARY OF THE INVENTION

It is therefore an object of the present invention is to solve the above problems associated with a conventional electrolytic cell having a gas diffusion electrode system used in the production of an alkali hydroxide, in that full use of the performance of a gas diffusion electrode cannot be achieved due to the failure of adequately supplying an oxygen-containing gas to the gas diffusion electrode surface. That is, an object of the present invention is to provide an electrolytic cell capable of producing an alkali hydroxide from an alkali chloride with great energy savings.

The above object has been achieved by providing an electrolytic cell for producing an alkali hydroxide comprising an anode chamber and a cathode chamber partitioned by an ion-exchange membrane, the cathode chamber having a gas diffusion electrode in intimate contact with the ion-exchange membrane, means for supplying an alkali chloride to the anode chamber and an oxygen-containing gas to the cathode chamber to generate chlorine in the anode chamber and an alkali hydroxide in the cathode chamber, and a gas distributing mechanism disposed in the cathode chamber for supplying said oxygen-containing gas to the surface of the gas diffusion electrode.

In a preferred embodiment, the gas distributing mechanism comprises at least one oxygen-containing gas diffuser pipe having a plurality of openings for gas diffusion.

DETAILED DESCRIPTION OF THE INVENTION

Figure 1:
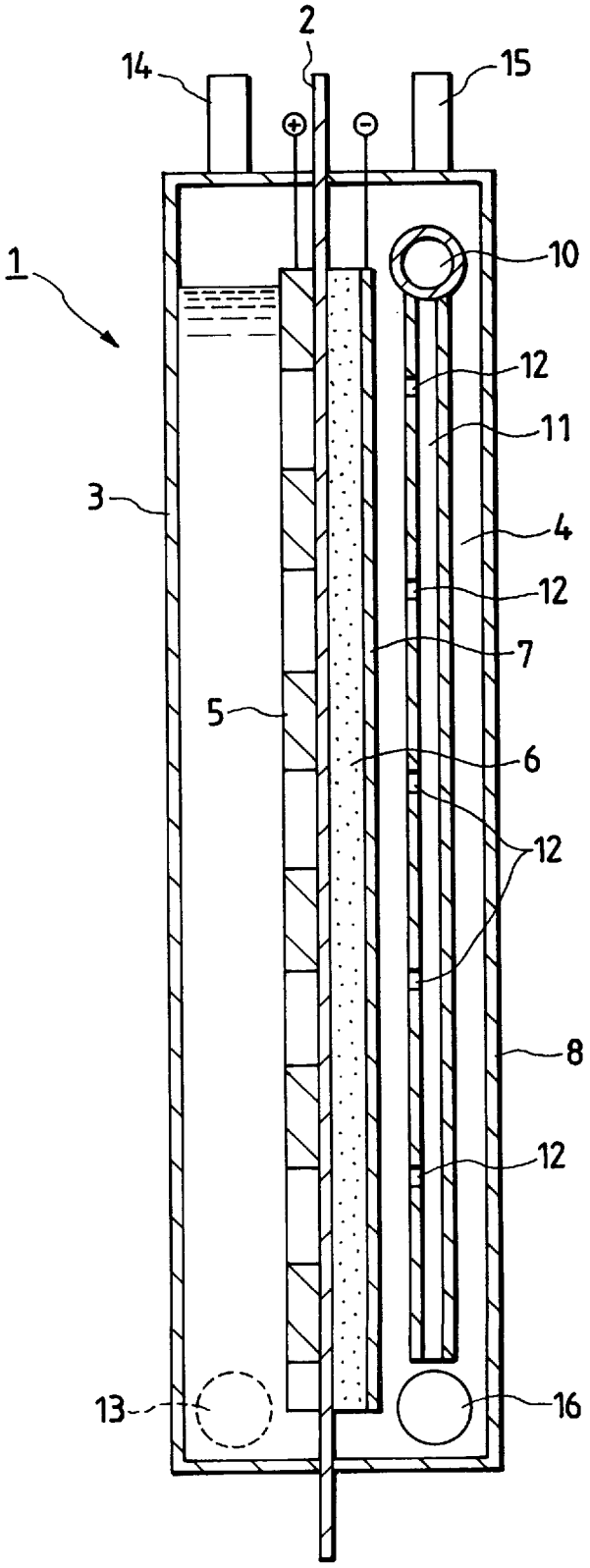
FIG. 1 is a cross section showing an example of the electrolytic cell according to the present invention.

In the present invention, a gas distributing mechanism is disposed in the cathode chamber for uniformly supplying an oxygen-containing gas to the whole surface of a gas diffusion cathode (i.e., the gas diffusion electrode disposed in the cathode chamber).

The gas distributing mechanism diffuses an oxygen-containing gas to uniformly supply the same over the entire surface of the gas diffusion cathode. Specifically, the gas distributing mechanism includes an oxygen-containing gas diffuser pipe having openings for gas diffusion. A plurality of such oxygen-containing gas diffuser pipes is preferably arranged in conformance with the size of the cathode chamber, more precisely, the surface area of the gas diffusion cathode. A single gas diffuser pipe may be sufficient for a small-sized electrolytic cell.

When a plurality of gas diffuser pipes are used, a pipe for oxygen-containing gas introduction is preferably arranged which branches off into a plurality of gas diffusing pipes. An oxygen-containing gas may be supplied directly from outside the electrolytic cell to each individual gas diffuser pipe. The plural diffuser pipes may be arranged in a checkered pattern, but such piping is difficult to make and requires a large space. The gas diffuser pipes are preferably arranged in parallel, either vertically or horizontally.

The diffuser pipe has a plurality of openings facing the gas diffusion cathode, through which an oxygen-containing gas is diffused toward the surface of the cathode in an atomized state. The distribution of the openings determines the uniformity of the oxygen-containing gas supply to the gas diffusion cathode surface.

The optimum interval of the openings, i.e., the number of the openings, is preferably about one for a cathode area of 20×20 cm to 30×30 cm, and varies depending on the inner diameter of the diffuser pipe, the diameter of the opening, the size of the electrolytic cell, and the like. Under some conditions, one opening for a cathode area of up to 50×50 cm can produce a sufficient diffusing effect. While there is no need to make more than one opening per 20×20 cm under ordinary conditions, the openings may be distributed more densely at and in the vicinity of the end plate, either in a bipolar system or a unipolar system. This is because the temperature tends to drop near the end plate.

The inner diameter of the diffuser pipe and the diameter of the openings are not particularly limited. The oxygen-containing gas is preferably supplied without applying pressure. Accordingly, these diameters are preferably selected so as to minimize pressure drop. Depending on the size of the electrolytic cell, the inner diameter of the diffuser pipe is preferably 10 mm or more, and the diameter of the opening is preferably about 0.3 to 3 mm, particularly about 1 mm. If the diameters are less than the respective lower limits, the pressure drop cannot be disregarded. If the diameter of the opening exceeds the upper limit, the gas is hardly diffused uniformly.

The inner temperature of the gas introducing pipe and the gas diffuser pipe is preferably kept above a given temperature so that the moisture in the gas is not condensed. Since the inside of the electrolytic cell is usually maintained at 80 to 90° C., condensation seldom forms. In order to prevent condensation, the gas introducing pipe and the gas diffuser pipe are preferably made of a material having as poor a heat conductivity as possible. Specifically, the gas introducing pipe and the diffuser pipe are preferably made of a resin. Because the inner temperature of the electrolytic cell is usually 80 to 90° C., sometimes reaching 100° C., a resin having a high heat resistance is preferably selected. Fluorine resins that undergo little change in shape and hardness even when subjected to such high temperatures, such as PTFE, are most preferred.

While the gas distributing mechanism for use in the present invention has been described mainly with reference to an oxygen-containing gas diffuser pipe, other means can also be used as the gas distributing mechanism. For example, the gas distributing mechanism can comprise passageways for an oxygen-containing gas provided in a current collector for applying an electric current to the gas diffusion cathode. Furthermore, the oxygen-containing gas for use in the present invention preferably contains water, particularly saturated steam. When water is supplied by other means, a dry oxygen-containing gas may be supplied to the surface of the gas diffusion cathode through the above-described gas distributing mechanism.

The gas diffusion cathode for use in the present invention may be either a liquid-permeable electrode or a semi-hydrophobic electrode. The shape of the gas diffusion cathode is not limited to a flat shape. For example, the cathode can be provided with guide louvers sloping downward for smooth removal of alkali hydroxide produced from the cathode surface, or a plurality of narrow cathode plates or bars can be arranged in parallel.

Figure 2:
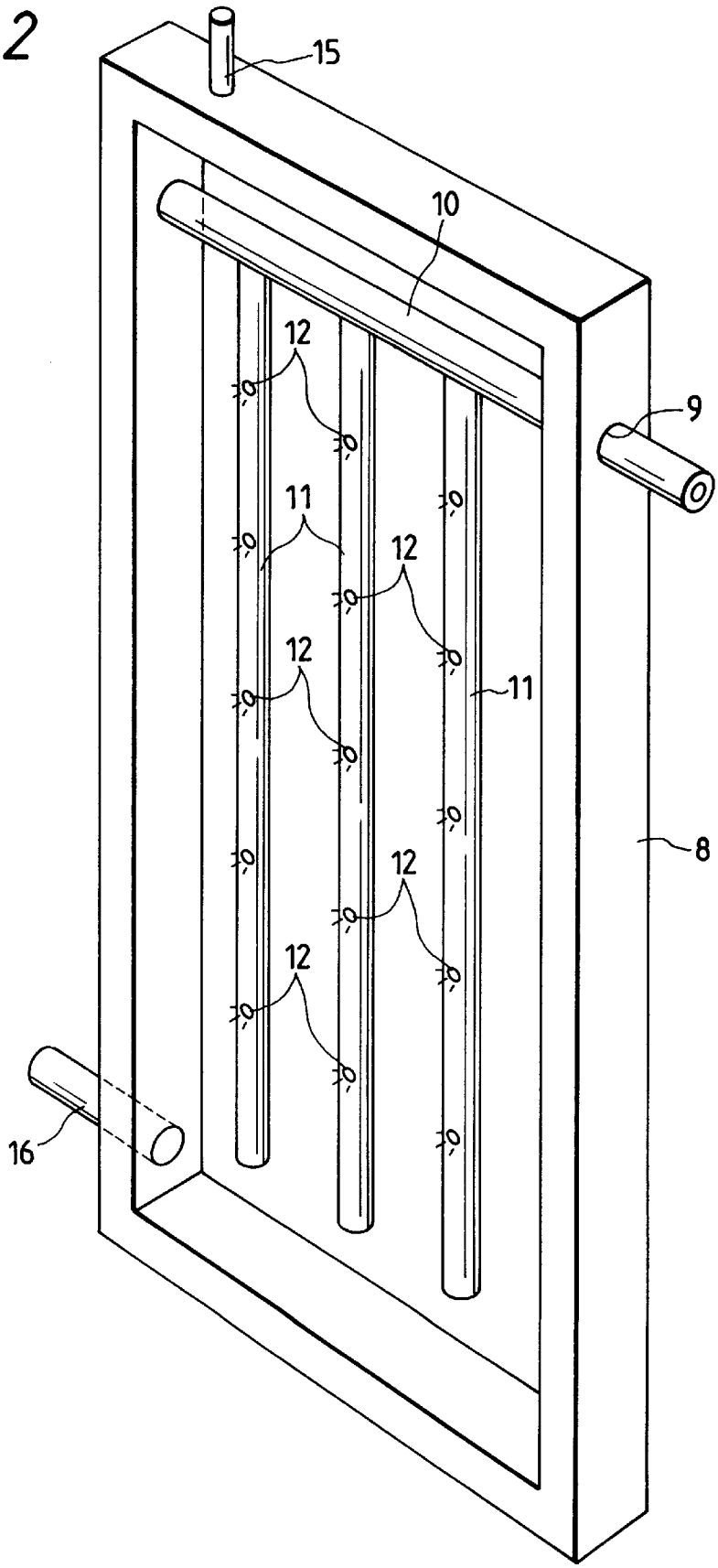
FIG. 2 is a perspective view of the cathode chamber of the electrolytic cell of FIG. 1.

FIG. 1 is a cross section showing an example of the electrolytic cell according to the present invention, and FIG. 2 is a perspective view of the cathode chamber of the electrolytic cell of FIG. 1 from which the cathode and current collector have been removed.

The electrolytic cell 1 is partitioned by an ion-exchange membrane 2 into an anode chamber 3 and a cathode chamber 4. In the anode chamber 3, a mesh-type insoluble anode 5 is placed in contact with the ion-exchange membrane 2. In the cathode chamber 4, a liquid-permeable gas diffusion cathode 6 is placed in contact with the ion-exchange membrane 2. A mesh current collector 7 contacts the surface of the gas diffusion cathode 6 for applying current to the cathode 6.

The cathode chamber is made of a frame 8 having side walls. An inlet 9 for introducing an oxygen-containing gas is provided on the upper part of the front side of the frame 8 (the right-hand side wall in FIG. 2). A cylindrical oxygen-containing gas introducing pipe 10 is inserted through the inlet 9, almost reaching the opposite side wall. Three oxygen-containing gas diffuser pipes 11 are connected to the lower side of the gas introducing pipe 10 at approximately regular intervals, extending downward, each having five openings 12 on the side facing the cathode 6 at approximately regular intervals.

Numeral 13 is an outlet for the anolyte provided on the side wall of the anode chamber; 14 is an outlet for the anodic gas provided on the top of the anode chamber; 15 is an outlet for excess gas formed on the top of the cathode chamber; and 16 is an outlet for removing alkali hydroxide produced by the electrolysis and provided on the side wall of the cathode chamber.

An anolyte, for example, brine is supplied to the anode chamber 3 of the electrolytic cell 1. Current is applied between the anode 5 and the cathode 6 while supplying a moistened oxygen-containing gas to the cathode chamber 4 from the gas introducing pipe 10 through the openings 12 of the gas diffuser pipes 11. Sodium hydroxide is produced on the surface of the gas diffusion cathode 6 in contact with the ion-exchange membrane 2. The sodium hydroxide thus produced and accompanying water pass through the liquid-permeable gas diffusion cathode 6 and reach the surface of the cathode 6.

By uniformly supplying the surface of the gas diffusion cathode 6 with moistened oxygen-containing gas from the openings 12, the aqueous sodium hydroxide solution appearing on the surface of the cathode 6 has a uniform water content to provide a sodium hydroxide solution with no concentration gradient. Furthermore, because the entire surface of the gas diffusion cathode 6 is supplied with the oxygen-containing gas, hydrogen ion is thoroughly oxidized into water. Therefore, there is no evolution of hydrogen gas, thereby eliminating the consumption of excess energy.

The present inventors also investigated the ratio of the oxygen-containing gas in the cathode chamber and the catholyte. It was found that when the percentage of the volume of the supplied oxygen-containing gas under atmospheric pressure to the total volume of the cathode chamber (hereinafter referred to as a volumetric gas ratio) is 50% or higher, noticeable improvements are obtained.

At a volumetric gas ratio of 50% or higher, the amount of catholyte in the cathode chamber decreases. This reduces the possibility of covering the surface of the gas diffusion cathode with the catholyte. As a result, the supplied gas is not hindered from reaching the surface of the gas diffusion cathode to take part in the electrode reaction so that the desired reaction proceeds smoothly.

Because of the smooth supply, the oxygen-containing gas reaches the overall surface of the gas diffusion cathode with ease. Therefore, a slight excess of gas over the theoretical amount is sufficient to allow the reaction to make sufficient progress.

The increase in efficiency achieved by sufficient progress of the reaction, the reduction in cost of the oxygen-containing gas itself, and the possibility for simplifying the means for supplying the oxygen-containing gas lead to great energy savings. It is considered that an increased proportion of the gas in the cathode chamber, i.e., occupation of a large proportion of the cathode chamber space by the gas, helps to smoothly diffuse the gas and also decreases the thickness of the liquid layer on the gas diffusion cathode surface. As a result, the time required for diffusing the gas in the liquid layer is reduced.

When a volumetric gas ratio is less than 50%, the electrolytic voltage tends to rise due to coating of the cathode surface with the catholyte and a resultant increase in the thickness of the liquid layer. As a result, hydrogen tends to evolve from the cathode surface. These phenomena can be prevented by setting the volumetric gas ratio at 50% or higher.

The electrolytic cell according to the present invention includes a system in which the water permeating the ion-exchange membrane together with alkali metal ion generated in the anode chamber is substantially the only liquid that is supplied to the cathode chamber (in many cases, deionized water is added to the oxygen-containing gas to adjust the water content in the cathode chamber), and a system in which a catholyte is supplied (circulated) to the cathode chamber in addition to the permeating water. The above-mentioned effects are achieved independent of the system employed.

In the former system of electrolysis, because the cell is designed to minimize the capacity of the cathode chamber, the volumetric gas ratio tends to become less than 50%. This occurs when withdrawal of the catholyte-consisting of the permeated water and alkali hydroxide thus produced is insufficient. In this case, the volumetric gas ratio can be increased to 50% or higher by rapidly removing the catholyte. When a reduction in the volumetric gas ratio is expected, the cathode chamber can be widened so that the volumetric gas ratio does not fall below 50%. The oxygen-containing gas supplied to the cathode chamber can be increased to secure a volumetric gas ratio of 50% or higher. It is also possible to circulate the oxygen-containing gas to increase the relative volume of the gas.

In the latter system, when the volumetric gas ratio decreases below 50%, the catholyte present in the cathode chamber can be removed from the system or the amount of the gas can be increased by circulation.

Although the volumetric gas ratio cannot be directly measured during operation, a reduction in volumetric gas ratio is roughly estimated by monitoring the electrolytic voltage. If a reduction in volumetric gas ratio is observed from the voltage measurement, the voltage is adjusted to the original level by increasing the volumetric gas ratio by any of the above-described means.

The gas diffusion cathode for use in the present invention is not particularly limited and includes a semi-hydrophobic electrode which is composed of a reactive layer and a gas diffusive layer joined together. Both can be made of carbon particles, such as carbon black or graphite, having supported thereon a catalyst (e.g., a platinum catalyst) and a binder, such as PTFE; and a liquid-permeable electrode which allows the reaction product to permeate therethrough to the opposite side (i.e., the cathode chamber side).

In addition to carbon particles, porous bodies of nickel, stainless steel, etc., can also be used as an electrode structure for the reactive layer, gas diffusive layer, etc. Unlike carbon particles, these electrode materials undergo no corrosion so that the catalyst does not suffer from poisoning. Therefore, electrolysis can be continued stably for an extended period of time. Furthermore, because the electrode thus used is in intimate contact with the ion-exchange membrane, the electric resistance is considerably reduced. As a result, the effect of reducing the electrolytic voltage is even more advantageous.

The present invention will now be illustrated in greater detail with reference to the following Examples, but it should be understood that the present invention is not to be construed as being limited thereto.

EXAMPLE 1

Nickel foam having a width of 50 mm, collapsed by compressing, was coated on one side thereof with ultrafine silver powder having an average particle size of 0.8 μm and on the other side with nickel powder having an average particle size of 5 μm, using a fluorine resin as a binder, to obtain a liquid-permeable gas diffusion cathode. A plurality of the gas diffusion cathodes were adhered at 1 mm intervals onto a louvered, perforated nickel plate current collector.

A general-purpose two-chamber electrolytic cell for an ion-exchange membrane process (DD 88 Cell, manufactured by De Nora; effective electrode area: 1200 mm (h)×750 mm (w)) equipped with an ion-exchange membrane (Nafion® 961, sulfonated flurocarbon copolymer, produced by E.I. du Pont de Nemours & Co., Inc.) was used as an electrolytic cell for the electrolysis of brine. The above-prepared gas diffusion cathode was placed in the cathode chamber in intimate contact with the ion-exchange membrane. An insoluble anode composed of an expanded metal mesh coated with a complex oxide mainly comprising ruthenium oxide and containing small amounts of iridium oxide and titanium oxide was placed in intimate contact with the opposite side of the ion-exchange membrane.

The electrolytic cell had an air-tight structure. As shown in FIGS. 1 and 2, an oxygen-containing gas introducing pipe and an outlet for sodium hydroxide were provided. As illustrated, three gas diffuser pipes having an inner diameter of 10 mm were connected downward from the gas introducing pipe. Each gas diffuser pipe had openings measuring 3 mm in diameter on the side facing the gas diffusion cathode at 100 mm intervals in the vertical direction, in such a manner that an atomized oxygen-containing gas from each gas diffuser pipe might be supplied to one of equally divided three sections of the cathode surface. Excess oxygen gas was removed together with the sodium hydroxide that was produced (an outlet 15 for the removal of excess oxygen-containing gas as shown in FIGS. 1 and 2 was not provided).

Electrolysis was carried out at a temperature of 80° C. and a current density of 30 A/dm$^2$ while supplying oxygen gas saturated with steam to the cathode surface in 10% excess over the theoretical oxygen amount and circulating 200 g/l brine through the anode chamber to produce sodium hydroxide in the cathode chamber. The initial electrolytic voltage was 2.15 V, which did not change after operating for 10 consecutive days. The resulting sodium hydroxide aqueous solution had a concentration of 32%, and the current efficiency was 94 to 96%.

COMPARATIVE EXAMPLE 1

Sodium hydroxide was produced by electrolysis of brine under the same conditions as in Example 1, except that an oxygen-containing gas introducing pipe was not provided and oxygen gas saturated with steam was directly supplied to the cathode chamber. The electrolytic voltage was 2.22 V in the initial stage, showing no great difference from Example 1, but immediately increased and reached a steady state at around 2.4 V. The resulting sodium hydroxide aqueous solution had a concentration of 31.5%, and the current efficiency was 92 to 94%. The reductions in sodium hydroxide concentration and current efficiency were considered to be caused by a local shortage of water (due to a water content distribution in the cathode chamber) and the local evolution of hydrogen (due to a lack of uniformity in the gas distribution).

EXAMPLE 2

Nickel foam having a thickness of 3 mm and a porosity of 90% was compressed to a thickness of 0.6 mm to make a porous plate. Activated silver powder having an average particle size of 0.8 μm was hot-press bonded onto one side of the porous plate using a PTFE suspension (available from E.I. du Pont; reference number: J30) as a binder to form a catalyst layer. On the other side of the porous plate an expanded titanium mesh having an apparent thickness of 0.5 mm was adhered as a liner to prepare a liquid-permeable gas diffusion cathode having an apparent thickness of 0.8 mm and a porosity of about 50%.

The catalyst layer side of the gas diffusion cathode was brought into intimate contact with an ion-exchange membrane (Nafion® 961, sulfonated flurocarbon copolymer, produced by E. I. du Pont) to construct a cathode chamber. An insoluble anode composed of a titanium lath coated with a ruthenium-titanium complex oxide (also known as a DSE) was placed on the anode chamber side of the ion-exchange membrane to make a two-chamber electrolytic cell.

Electrolysis was carried out at a temperature of 80° C. and a current density of 30 A/dm$^2$ while supplying oxygen gas moistened with deionized water to the cathode surface in 20% excess over the theoretical oxygen amount and circulating 200 g/l brine through the anode chamber to produce sodium hydroxide in the cathode chamber. The volumetric gas ratio in the cathode chamber during the electrolysis was stepwise reduced from 70% to 50% as shown in Table 1 below by adjusting the capacity of the cathode chamber. The electrolytic voltage was measured, and hydrogen gas evolution was examined. The results obtained are shown in Table 1.

As seen from Table 1, when the volumetric gas ratio was 50% or higher, the electrolytic voltage was not more than 2.15 V, and slight hydrogen evolution was not observed until the volumetric gas ratio was reduced to 50%.

COMPARATIVE EXAMPLE 2

Electrolysis of brine was carried out under the same conditions as in Example 2, except for starting at a volumetric gas ratio of 45% and reducing to 40% and then to 25%. The electrolytic voltage was measured, and hydrogen gas evolution was examined. The results obtained are shown in Table 1.

As seen from Table 1, when the volumetric gas ratio was less than 50%, the electrolytic voltage showed a steep rise, and hydrogen evolution was considerable.

TABLE 1

| | Example 2 | | | | Comparative Example 2 | | |
|---|---|---|---|---|---|---|---|
| Volumetric Gas Ratio (%) in Cathode Chamber | 70 | 60 | 55 | 50 | 45 | 40 | 35 |
| Electrolytic Voltage (V) | 2.12 | 2.11 | 2.14 | 2.15 | 2.38 | 2.45 | 2.88 |

TABLE 1-continued

| | Example 2 | | | | Comparative Example 2 | | |
|---|---|---|---|---|---|---|---|
| Hydrogen Evolution | not observed | not observed | not observed | slightly observed | observed | observed | observed |

EXAMPLE 3

A liquid-permeable gas diffusion cathode was prepared in the same manner as in Example 2, except that the expanded mesh adhered to the porous plate was half rolled to form an unevenness and the amount of PTFE applied was increased to improve hydrophobic properties. A two-chamber electrolytic cell was constructed using the resulting gas diffusion cathode. The reduction in cathode chamber capacity due to a 0.5 mm increase in apparent thickness of the cathode was offset by increasing the width of the cathode chamber accordingly.

Electrolysis of brine was carried out at a temperature of 80° C. and a current density of 30 A/dm$^2$ while circulating a 32% sodium hydroxide aqueous solution and oxygen gas (in 50% excess over the theoretical amount) at a varied ratio in the cathode chamber so as to provide a volumetric gas ratio of 70%, 60%, 55% or 50% as shown in Table 2 below. In the anode chamber, 200 g/l brine was circulated. The electrolytic voltage was measured, and hydrogen gas evolution was examined. The results obtained are shown in Table 2.

COMPARATIVE EXAMPLE 3

Electrolysis of brine was carried out under the same conditions as in Example 3, except for changing the volumetric gas ratio in the cathode chamber to 45%, 40%, 20% or 10% as shown in Table 2. The electrolytic voltage was measured, and hydrogen gas evolution was examined. The results obtained are shown in Table 2.

TABLE 2

| | Example 3 | | | | Comparative Example 3 | | | |
|---|---|---|---|---|---|---|---|---|
| Volumetric Gas Ratio (%) | 70 | 60 | 55 | 50 | 45 | 40 | 20 | 10 |
| Electrolytic Voltage (V) | 2.23 | 2.31 | 2.24 | 2.35 | 2.48 | 2.64 | 2.88 | 2.89 |
| Hydrogen Evolution | not observed | not observed | not observed | not observed | observed | observed | observed | observed |

As is shown in Table 2, when the volumetric gas ratio was less than 50%, the electrolytic voltage rapidly increased, and considerable hydrogen evolution was observed. In particular, at volumetric gas ratios of 20% or lower, the gas diffusion cathode lost its function due to an abnormal rise in the electrolytic voltage, and only hydrogen evolution resulted.

As described above, the present invention provides an electrolytic cell for producing an alkali hydroxide comprising an anode chamber and a cathode chamber partitioned by an ion-exchange membrane. The cathode chamber has a gas diffusion electrode in intimate contact with the ion-exchange membrane. Electrolysis is carried out while supplying an alkali chloride and an oxygen-containing gas to the anode chamber and the cathode chamber, respectively, to generate chlorine and an alkali hydroxide in the anode chamber and the cathode chamber, respectively. Furthermore, the oxygen-containing gas is supplied to the surface of the gas diffusion cathode by means of a gas distributing mechanism disposed in the cathode chamber.

In a conventional electrolytic cell for producing an alkali hydroxide employing a gas diffusion cathode, oxygen-containing gas is directly introduced into the cathode chamber. The gas thus supplied does not uniformly reach the whole surface of the gas diffusion cathode, thereby generating a gradient in the supplied gas concentration on the cathode surface.

According to the present invention, the oxygen-containing gas is uniformly supplied over the whole gas diffusion cathode by means of the gas distributing mechanism so that the gas reaction proceeds at an almost uniform rate on the entire surface of the cathode surface. As a result, the unnecessary evolution of hydrogen does not occur, and electrolytic production of an alkali hydroxide can be accomplished at a great energy savings.

The gas distributing mechanism preferably comprises at least one oxygen-containing gas diffuser pipe having a plurality of openings for gas diffusion. The diffuser pipe is preferably made of a resin, such as a fluorine resin, for improving heat resistance and preventing condensation. In place of a separately provided diffuser pipe, the gas distributing mechanism may comprise passageways for an oxygen-containing gas provided in a current collector for applying an electric current to the gas diffusion cathode. This type of gas distributing mechanism is particularly suited to a small-sized electrolytic cell having insufficient space to set the above-described diffuser pipe in the cathode chamber.

Furthermore, when the volumetric gas ratio in the cathode chamber of an electrolytic cell for producing an alkali hydroxide is maintained at 50% or higher, the oxygen-containing gas is smoothly diffused in the cathode chamber to obtain enhanced performance of the gas diffusion cathode. A slight excess of an oxygen-containing gas over the theoretical amount is sufficient for the electrode reaction to make sufficient progress. Because an oxygen-containing gas is adequately supplied to the gas diffusion cathode, hydrogen ion conversion into water is substantially complete, thus obviating the danger of explosion.

While the invention has been described in detail and with reference to specific examples thereof, it will be apparent to one skilled in the art that various changes and modifications can be made therein without departing from the spirit and scope thereof.

What is claimed is:

1. An electrolytic cell for producing an alkali hydroxide comprising an anode chamber and a cathode chamber partitioned by an ion-exchange membrane, the cathode chamber having a gas diffusion electrode in intimate contact with the ion-exchange membrane, means for supplying an alkali chloride to the anode chamber and an oxygen-containing gas to the cathode chamber to generate chlorine in the anode chamber and an alkali hydroxide in the cathode chamber, and a gas distributing mechanism disposed in the cathode chamber for supplying said oxygen-containing gas to the surface of the gas diffusion electrode, wherein said gas distributing mechanism comprises at least one vertically arranged gas diffuser pipe having a plurality of openings for gas diffusion.

2. The electrolytic cell according to claim 1, wherein said gas diffuser pipe is made of a resin.

3. The electrolytic cell according to claim 2, wherein said resin comprises a fluorine resin.

4. The electrolytic cell according to claim 1, comprising two or more gas diffuser pipes arranged in parallel.

5. The electrolytic cell according to claim 1, wherein said openings for gas diffusion face the gas diffusion electrode.

6. The electrolytic cell according to claim 1, wherein about one opening is provided for a cathode area of 20×20 cm to 30×30 cm.

7. The electrolytic cell according to claim 1, wherein said at least one gas diffuser pipe has an inner diameter of 10 mm or more and said openings have a diameter of about 0.3 to 3 mm.

8. The electrolytic cell according to claim 1, comprising means for supplying a moistened oxygen-containing gas to the cathode chamber.

9. The electrolytic cell according to claim 1, further comprising a current collector for applying electric current to the gas diffusion electrode, and wherein said gas distributing mechanism comprises passageways provided in the current collector for supplying the oxygen-containing gas.

10. An electrolytic cell for producing an alkali hydroxide comprising an anode chamber and a cathode chamber partitioned by an ion-exchange membrane, the cathode chamber having a gas diffusion electrode in intimate contact with the ion-exchange membrane, means for supplying an alkali chloride to the anode chamber and an oxygen-containing gas to the cathode chamber to generate chlorine in the anode chamber and an alkali hydroxide in the cathode chamber, and means for maintaining a volumetric gas ratio in said cathode chamber of 50% or higher.

11. The electrolytic cell according to claim 10, comprising means for adjusting the capacity of the cathode chamber.

12. The electrolytic cell according to claim 10, comprising means for circulating oxygen-containing gas supplied to the cathode chamber.

13. The electrolytic cell according to claim 10, comprising means for removing catholyte from the cathode chamber.

14. The electrolytic cell according to claim 10, comprising means for maintaining a volumetric gas ratio in said cathode chamber of 60% or higher.

15. The electrolytic cell according to claim 10, comprising means for maintaining a volumetric gas ratio in said cathode chamber of 70% or higher.

* * * * *